United States Patent [19]

Chipner et al.

[11] 4,100,448

[45] Jul. 11, 1978

[54] LAMP AND SOCKET ASSEMBLY

[75] Inventors: Russell W. Chipner, South Euclid; James C. Graff, Cleveland Heights, both of Ohio

[73] Assignee: General Electric Company, Schenectady, N.Y.

[21] Appl. No.: 793,049

[22] Filed: May 2, 1977

[51] Int. Cl.[2] ..... H01K 1/44

[52] U.S. Cl. ..... 313/318; 313/51; 339/119 L; 339/125 L; 362/267; 362/306

[58] Field of Search ..... 313/318, 50, 51; 362/267, 306; 339/91 L, 125 L, 119 L

[56] References Cited

U.S. PATENT DOCUMENTS

| | | | |
|---|---|---|---|
| 3,749,960 | 7/1973 | Fuqua et al. | 313/318 |
| 3,999,095 | 12/1976 | Pearce et al. | 313/318 |
| 4,019,045 | 4/1977 | Bassett | 362/267 |

*Primary Examiner*—Alfred E. Smith
*Assistant Examiner*—Charles F. Roberts
*Attorney, Agent, or Firm*—Paul F. Wille; Lawrence R. Kempton; Frank L. Neuhauser

[57] ABSTRACT

An improved lamp and socket assembly is disclosed in which a socket collar is mechanically secured to the panel or reflector when the lamp is used. The base of the lamp attaches to the collar as does the electrical connector. The combination enables a more repeatable alignment of the lamp in the panel or reflector. A compact assembly is achieved by using nested cylinders in the parts.

9 Claims, 2 Drawing Figures

LAMP AND SOCKET ASSEMBLY

BACKGROUND OF THE INVENTION

This invention relates to lamps and, in particular, to a lamp and socket assembly providing repeatable mechanical alignment of the lamp and reliable electrical contact with the lamp.

In the past, a number of lamps used as signal lamps, e.g. for automobiles, comprised a brass base having pins for securing the base to the socket. As known in the art, the lamp can move slightly in its socket, making repeatable positioning of the filament difficult and allowing the lamp to change position due to vibration or shock. In addition, since the base is not sealed from dirt and moisture, the base may corrode and fuse to the socket causing poor electrical contact in service and breakage when the lamp is removed.

While "prefocused" lamps are available, in which the base contains a flange for mounting the lamp and from which the filament is accurately located, it is also desirable to reduce the number of types of bases. For example, it is desirable to have a single base and socket assembly which can be used for either front or rear insertion and which has the "prefocused" characteristic.

Prior attempts to solve these problems, for example, as described in U.S. Pat. Nos. 3,749,960 and 3,999,095, have not proven entirely satisfactory. In the former, the base of the lamp is mechanically secured to the panel or reflector by a locking ring or gasket while a connector attaches to the base of the lamp and electrically connects with pins protruding therefrom. Thus, replacement of the lamp is difficult due to the gasket. The separate gasket also adds to the parts count and cost. Further, the lamp and base are physically long which may be undesirable, e.g., in the trunk of a car.

The latter patent describes a lamp and socket having a shorter overall length. However, the lamp is mechanically connected to the electrical connector which, in turn, is mechanically connected to a panel or reflector by way of a resilient gasket. This indirect mechanical connection of the lamp to the reference (panel or reflector) particularly when combined with the resilient gasket can lead to errors in the positioning of the bulb. A partial solution is to manufacture the rigid parts to very tight tolerances so that cumulative errors do not exceed a predetermined tolerance. Even if this were done, the gasket remains a source of positioning error.

SUMMARY OF THE INVENTION

In view of the foregoing, it is therefore an object of the present invention to provide a lamp and socket assembly having more consistent positioning of the filament with respect to a reference feature.

Another object of the present invention is to provide a simplified lamp and socket construction.

A further object of the present invention is to provide a moisture and dust resistant seal for the lamp connectors when assembled.

Another object of the present invention is to provide a more compact lamp and socket construction.

The foregoing objects are achieved in the present invention wherein the assembly comprises a lamp having a base comprising a first cylinder having means to support the wire leads from the lamp. A socket collar, comprising a second cylinder, an annular ring, and indexing and latching means, is connected to the reflector or panel with the annular ring acting as both an interference or labyrinth seal and a reference plane. An electrical connector is positioned by the collar and can be held in place either by the collar or by latch means on the lamp base.

BRIEF DESCRIPTION OF THE DRAWINGS

A more complete understanding of the present invention can be obtained by considering the following detailed description in conjunction with the accompanying drawings, in which.

DESCRIPTION OF THE PREFERRED EMBODIMENTS

Figure 1:
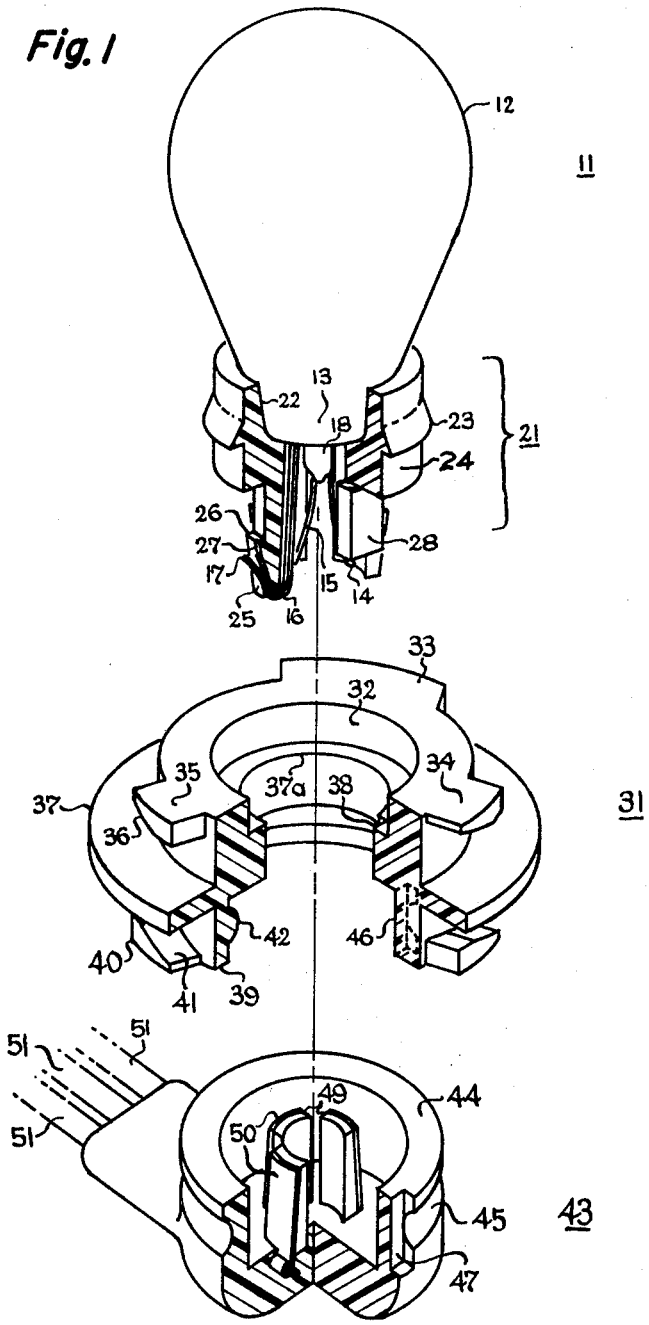
FIG. 1 is an exploded perspective view of a preferred embodiment of the present invention.

Referring to FIG. 1, a lamp and socket assembly in accordance with the present invention comprises a wire lamp 11, a lamp base 21, a socket collar 31, and a suitable connector 43. Specifically, bulb 11 is a wire lamp comprising a suitably transparent vitreous envelope 12 having a formed seal area 13 from which lead wires 14–17 and the residue of the exhaust tube 18 extend.

Base 21 comprises a suitable plastic capable of withstanding the operating temperatures of the lamp. Base 21 comprises a cylindrical member having a hollowed-out or enlarged portion 22 which fits around formed seal area 13 and is attached thereto by a suitable cement, known in the art. Base 21 further comprises an annular ring 23 which forms a step with lower portion 24 of base 21. Protruding from the lower side of base 21 are a plurality of pins, such as pin 25, having locking means 26 formed therein. Further, pins 25 comprise an axial groove 27 for receiving respective ones of leads 14–17 which extend through the central portion of base 21 and are wrapped about pins 25 and lie in the axial groove. Index pin 28 also extends axially from lower portion 24 and rotationally aligns the lamp about its axis.

Socket collar 31 also comprises a suitable plastic material which can be more flexible than that of base 21. The collar is molded in a generally cylindrical shape having an inside diameter 32 approximately equal to the outside diameter of lower portion 24 of base 21. Extending radially outward from the upper end of collar 31 are a plurality of locking tabs 33–35 for rear insertion of the collar. As indicated in FIG. 1, locking tabs 33–35 are preferably distinguishable to provide an indexing function, i.e., so that the collar can be inserted into a panel or reflector in only one manner. If desired, locking tabs 33–35 may include a beveled portion to facilitate the insertion thereof into a suitably shaped hole in the panel or reflector (not shown). Collar 31 comprises an outer annular ring 37 which rests against the panel or reflector to provide an interference seal against dirt and moisture. For this reason, annular ring 37 comprises at least 50% of the area defined by a circle having the same outside diameter. Collar 31 further comprises an inner annular ring **37*a* for receiving respective prongs 25 from lamp base 21. Notch 38 receives index pin 28. Lower end 39 of collar 31 is also provided with radially extending locking tabs, such as tab 40, having beveled portion 41** to provide a front insertion capability for the lamp and socket assembly.

Connector 43, which may also comprise a molded plastic, has an outer shell 44 having an outside diameter approximately equal to the inside diameter of lower portion 39 of collar 31. Shell 44 is provided with a cut or groove 45 for holding connector 43 in place by way of bead 42. Alternatively, recesses may be provided for receiving shoulders 26 on elongated pins 25 of the lamp base. Indexing of connector 43 is obtained by way of ridge 46 in collar 31 and groove 47 in connector 43.

Within shell 44 are a plurality of contact pins 49 having conductive tabs 50 fastened to the outside thereof. Conductive tabs 50, in turn, are connected to conductors 51 which supply power to the lamp.

Connector 43 is inserted into collar 31 against a stop defined by inner annular ring 37*a*. The lamp is inserted into the other side of collar 31 where prongs 25 engage inner annular ring 37*a*, thereby securely fastening the elements together. The entire assembly can then be inserted from the rear into a panel or reflector. Conversely, if front insertion is utilized, collar 31 is first attached to the base, the lamp inserted, and the connector attached afterward. While the lamp and socket assembly is illustrated in a preferred embodiment as being three separate pieces, collar 31 may be advantageously combined with either lamp base 21 or connector 43 as a one-piece unit. These and other modifications are illustrated in FIG. 2 in an alternative embodiment of the present invention.

Figure 2:
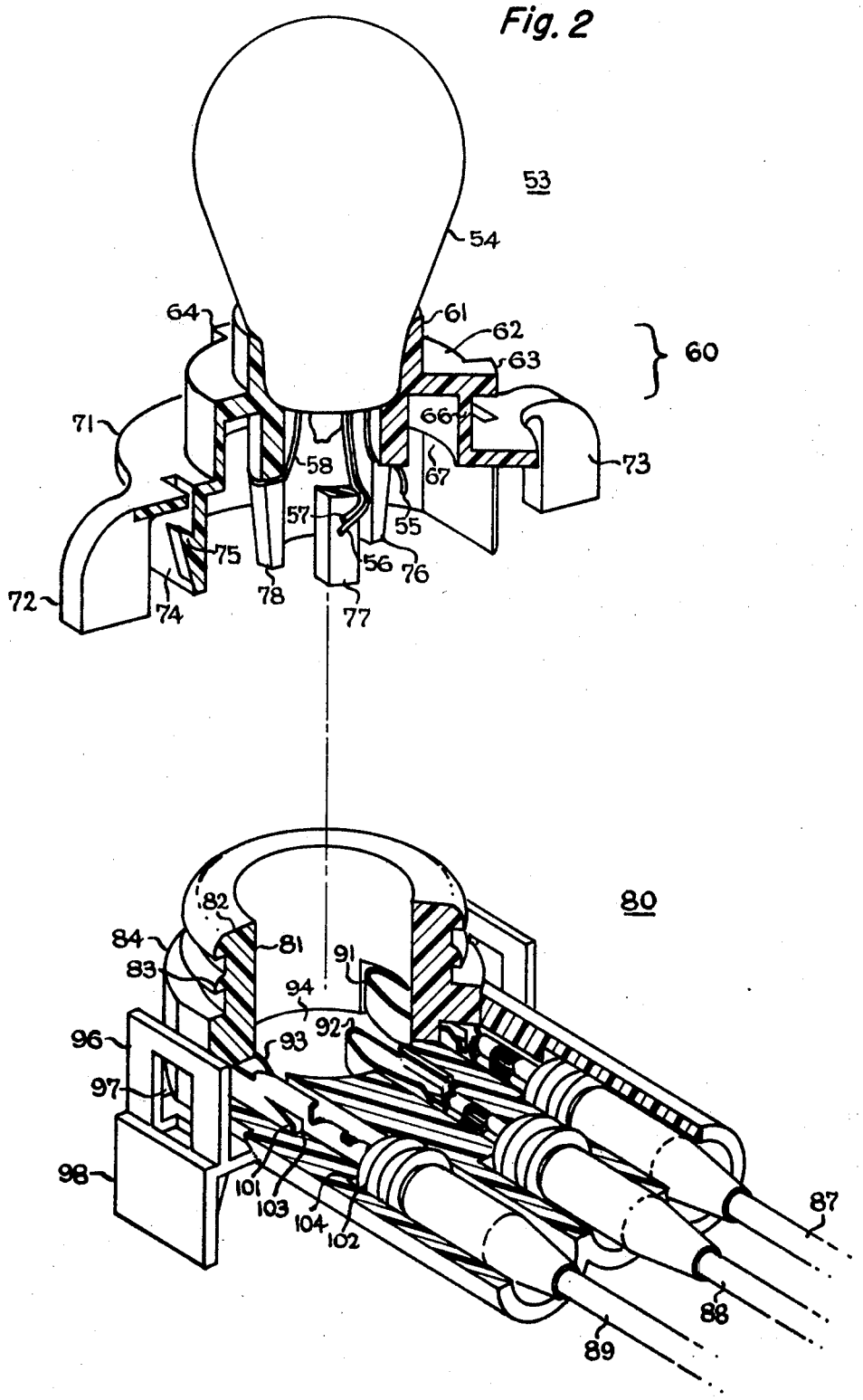
FIG. 2 is an exploded perspective view of an alternative embodiment of the present invention.

Specifically, in FIG. 2, the lamp base and collar have been combined into an integral unit 53 adapted for rear insertion into a panel or reflector and into which connector 80 is securely fastened to seal the lamp. Lamp unit 53 comprises a wire lamp having an envelope 54 from which lead wires 55–58 extend. Base 60 of lamp unit 53 comprises a molded plastic unit having a central cylindrical member 61, a portion of the interior of which is suitably shaped to receive the seal area of envelope 54, to which it is attached by any suitable adhesive known in the art. Surrounding cylindrical portion 61 is a first annular ring 62 having locking tabs 63 and 64 for securing the lamp unit to a panel or reflector. Extending from annular ring 62 is a second cylindrical section 66 having a diameter larger than the diameter of the first cylindrical section. Cylindrical sections 66 and 61 and annular ring 62 define a chamber 67 for receiving connector 80.

The lower portion of cylindrical section 66 is terminated in a second and larger annular ring 71, which corresponds to annular ring 37 in FIG. 1, i.e., is of a sufficient width to provide an interference seal for the lamp assembly. As a convenience to the user, tabs such as tabs 72 and 73, orthogonal to annular ring 71, may be provided to assist in the twisting action utilized to insert and lock lamp assembly 53 in place. Extending from the lower portion of annular ring 71 are suitable locking members, exemplified in FIG. 2 as comprising tab 74 and tapered shoulder 75.

In the interior of lamp assembly 53, central cylindrical member 61 terminates in a plurality of pins 76–78, around which are wound lead wires 55–58, respectively. While illustrated in FIG. 2 as comprising a two-filament lamp having two of the lead wires, 56 and 57, joined to form a common lead, it is understood by those of skill in the art that the base and collar unit 60 is also suitable for use with a single-filament lamp or, with an additional pin, for use with a lamp having four independent leads.

Connector unit 80, molded of a suitable resilient plastic known in the art, comprises a cylindrical unit dimensioned to fit within chamber 67. The outer surface of cylinder 81 comprises tapered ridges 82 and 83 which serve to seal connector 80 in place. Cylinder 81 further comprises a shoulder 84 extending around at least a portion thereof for engaging annular ring 71 thereby providing a stop to limit and control the insertion of connector 80.

The lower portion of connector 80 comprises wires 87–89 terminated in conductive contacts 91–93 which extend into the interior of cylinder 81 to make contact with lead wires 55–58, respectively. The lower portion of cylinder 81 is closed by floor 94. Thus, connector 80 is closed on three sides and fits into base 60 which is also closed on three sides. When connected, the combination effectively seals the contact area and provides a mechanically and electrically secure connection between wires 87–89 and lamp 53.

Although held in place by ridges 82 and 83, connector 80 is securely fastened to lamp 53 by way of locking tabs such as tab 96 having an aperture 97 into which tapered shoulder 75 fits. Tab 96 is attached to the lower portion of connector 80 including floor 94 and the extended portion surrounding wires 87–89.

To facilitate removal of connector 80, opposed tabs such as tab 98 are provided which are mechanically coupled to the locking tabs such that the locking tabs can be flexed out of position to clear tapered shoulder 75 and enable removal of connector 80. As is apparent to those of skill in the art, locking tabs 63 and 64 as well as the tabs on connector 80 may be asymmetrically located about the axis of the assembly to provide an indexing function.

Conductive contacts 91–93 comprise flat sheet metal strips curved back on themselves to form a resilient contact and are crimped or otherwise suitably fastened to the ends of wires 87–89. The leads are held in place by spring tab 101 and tapered ridge 102 which abut shoulders 103 and 104, respectively. Tapered ridge 102 also serves as a seal for the wire, preventing water or dirt from entering the contact area.

There is thus provided by the present invention a lamp and socket assembly which is compact, easily made, and mechanically accurate in the positioning of the filament relative to a panel or reflector. In addition to being mechanically secure, the electrical connections are more reliable due to the separate enclosure of the contact area, which is in addition to the sealing of the panel or reflector by the annular ring.

Having thus described the invention, it will be apparent to those of skill in the art that various modifications may be made within the spirit and scope of the present invention. For example, while described in FIG. 2 as combined with the base, the collar may be combined with the connector instead and comprise a softer plastic. With presently available materials, base 60 in FIG. 2 must be a hard plastic, i.e., capable of withstanding lamp operating temperatures. As such, a gasket may be desired for a moisture tight seal in some applications. Also, other forms of turning aids can be substituted for tabs 72 and 73 described in the embodiment of FIG. 2. Lead wires 87–89 and contacts 91–93 may be molded into connector 80 in a single operation rather than separately forming the plastic part and inserting the wires as indicated by FIG. 2. Rather than two sets of locking tabs on the socket collar of FIG. 1, a single set may be used and the socket collar reversed for either front or rear insertion. While a preferred embodiment is described in connection with a two-filament lamp, the teachings of the present invention apply to a single-filament lamp as well.

What we claim as new and desire to secure by Letters Patent of the United States is:

1. A prefocused lamp having at least one filament within a sealed vitreous envelope from which lead wires for the filament extend at the sealed end of the envelope and a base attached to said envelope, said base being suitable for front or rear insertion into a panel or reflector and comprising:

a first cylindrical member having an enlarged inside diameter portion for receiving the sealed end of said envelope and for establishing the axial position of said envelope with respect to said base, said first cylindrical member further having contact means extending axially away from said envelope and to which said lead wires are attached;

a second cylindrical member having an inside diameter greater than the outside diameter of said first cylindrical member;

a first annular ring, encircling said first cylindrical member, for establishing the axial position of the second cylindrical member with respect to the first;

a second annular ring, encircling said second cylindrical member and having an area greater than 50% of the area defined by the outside diameter thereof, axially located at a predetermined position with respect to said one filament to form a reference plane;

said second cylindrical member having locking tabs at either end thereof to secure said base to said panel or reflector.

2. The lamp as set forth in claim 1 wherein said locking tabs are located at both ends of said second cylindrical member.

3. The lamp as set forth in claim 1 wherein said locking tabs are located at one end of said second cylindrical member and said second annular ring is located at the other end.

4. The lamp as set forth in claim 1 and further comprising:

a third annular ring attached to the interior of said second cylindrical member; and wherein said first annular ring and cylindrical member form a base, and said second and third annular rings and second cylindrical member form a separate collar, said third annular ring axially locating said base with respect to said collar.

5. A lamp and socket assembly having at least one filament within a sealed vitreous envelope from which lead wires for the filament extend at the sealed end of the envelope and a base attached to said envelope, said base being suitable for front or rear insertion into a panel or reflector and comprising:

a first cylindrical member having an enlarged inside diameter portion for receiving the sealed end of said envelope and for establishing the axial position of said envelope with respect to said base, said first cylindrical member further having contact means extending axially away from said envelope to which said lead wires are attached;

a second cylindrical member having an inside diameter greater than the outside diameter of said first cylindrical member;

a first annular ring, encircling said first cylindrical member, for establishing the axial position of the second cylindrical member with respect to the first;

a second annular ring, encircling said second cylindrical member and having an area greater than 50% of the area defined by the outside diameter thereof, axially located at a predetermined position with respect to said one filament to form a reference plane;

a second cylindrical member having locking tabs at either end thereof to secure said base to said panel or reflector; and a third cylindrical member, closed on one end, having a plurality of conductive contacts aligned with said contact means, said third cylindrical member fitting within said second cylindrical member to engage and enclose said contacts.

6. The lamp and socket assembly as set forth in claim 5 and further comprising:

a third annular ring attached to the interior of said second cylindrical member; and wherein said first annular ring and cylindrical member form a base, and said second and third annular rings and second cylindrical member form a separate collar, said third annular ring axially locating said base with respect to said collar.

7. The lamp and socket assembly as set forth in claim 6 wherein said contact means and said connector include locking means for securely attaching said base and connector to said collar.

8. The lamp and socket assembly as set forth in claim 5 wherein said base and collar are an integral unit and wherein said collar and connector comprise locking means for securing one to the other.

9. The lamp and socket assembly as set forth in claim 8 wherein said locking means include means for releasing said connector from said integral unit.

* * * * *